US007198363B2

(12) United States Patent
Wexler

(10) Patent No.: US 7,198,363 B2
(45) Date of Patent: Apr. 3, 2007

(54) INKJET RECORDING ELEMENT AND METHOD OF USE

(75) Inventor: Allan Wexler, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/767,287

(22) Filed: Jan. 28, 2004

(65) Prior Publication Data

US 2005/0162495 A1 Jul. 28, 2005

(51) Int. Cl.
*B41J 2/01* (2006.01)

(52) U.S. Cl. ..... 347/105; 347/101; 428/32.1

(58) Field of Classification Search ..... 347/101, 347/105, 100, 96; 428/195, 32.1
See application file for complete search history.

(56) References Cited

U.S. PATENT DOCUMENTS

| | | | | |
|---|---|---|---|---|
| 4,785,313 A | | 11/1988 | Higuma et al. | |
| 4,832,984 A | | 5/1989 | Hasegawa et al. | |
| 6,497,480 | B1 * | 12/2002 | Wexler | 347/105 |
| 2004/0061764 | A1 * | 4/2004 | O'Connor et al. | 347/105 |

FOREIGN PATENT DOCUMENTS

| | | |
|---|---|---|
| EP | 0 983 866 | 3/2000 |
| EP | 0 987 120 | 3/2000 |
| EP | 1188573 A2 | 3/2002 |
| EP | 0858905 B1 | 11/2002 |
| EP | 1 293 356 | 3/2003 |
| WO | 00/63024 | 10/2000 |

* cited by examiner

*Primary Examiner*—Manish S. Shah
(74) *Attorney, Agent, or Firm*—Chris P. Konkol

(57) ABSTRACT

An inkjet recording element having a support having thereon in order: a) a fusible, porous ink-receptive layer of fusible polymeric particles and a binder; b) a fusible, porous ink-transporting layer of fusible, polymeric particles and a film-forming, hydrophobic binder. The invention is also directed to an inkjet printing process wherein the ink-receptive layer and/or the support, each either alone or in combination, is capable of receiving substantially all of the ink carrier liquid received after the ink carrier liquid has passed through the ink-receptive layer.

21 Claims, No Drawings

INKJET RECORDING ELEMENT AND METHOD OF USE

FIELD OF THE INVENTION

The present invention relates to a porous inkjet recording element.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol, or mixtures thereof.

An inkjet recording element typically comprises a support having on at least one surface thereof at least one ink-receiving layer. The ink-receiving layer is typically either a porous layer that imbibes the ink via capillary action, or a polymer layer that swells to absorb the ink. Transparent swellable hydrophilic polymer layers do not scatter light and therefore afford optimal image density and gamut, but take an undesirably long time to dry. Porous ink-receiving layers are usually composed of inorganic or organic particles bonded together by a binder. During the inkjet printing process, ink droplets are rapidly absorbed into the coating through capillary action and the image is dry-to-touch right after it comes out of the printer. Therefore, porous coatings allow a fast "drying" of the ink and produce a smear-resistant image. However porous layers, by virtue of the large number of air particle interfaces, scatter light, which results in lower densities of printed images.

Elements which comprise two distinct layers have been constructed which have an uppermost porous layer and an underlying swellable polymer layer. Such constructions suffer from poor image quality, as the rate of ink absorption in the upper porous layer via capillary action is orders of magnitude faster than absorption by ink diffusion into the swellable layer. This difference in absorption rates leads to unwanted lateral diffusion of ink in the uppermost layer when the ink fluid reaches the interface between the layers. This unwanted lateral diffusion of the ink is a phenomenon termed "bleed" in the art.

Inkjet prints, prepared by printing onto inkjet recording elements, are subject to environmental degradation. They are especially vulnerable to damage resulting from contact with water and atmospheric gases such as ozone. The damage resulting from the post imaging contact with water can take the form of water spots resulting from deglossing of the top coat, dye smearing due to unwanted dye difflusion, and even gross dissolution of the image recording layer. Ozone bleaches inkjet dyes resulting in loss of density. To overcome these deficiencies, inkjet prints are often laminated. However, lamination is expensive as it requires a separate roll of material.

Efforts have been made to avoid lamination and yet provide protected inkjet prints by providing an inkjet receiver having an uppermost fusible ink-transporting layer and an underlying ink-retaining layer.

U.S. Pat. Nos. 4,785,313 and 4,832,984 relate to an inkjet recording element comprising a support having thereon a porous fusible, ink-transporting layer and a swellable polymeric ink-retaining layer, wherein the ink-retaining layer is non-porous. However, there is a problem with this element in that it has poor image quality.

EP 858,905A1 relates to an inkjet recording element having a porous fusible ink-transporting outermost layer formed by heat sintering thermoplastic particles, and an underlying porous layer to absorb and retain the ink applied to the outermost layer to form an image. The underlying porous ink-retaining layer is constituted mainly of refractory pigments. After imaging, the outermost layer is made non-porous. There are problems with this element in that the ink-retaining layer remains light scattering and therefore fused prints suffer from low density, and the sintered outermost layer has poor abrasion resistance.

EP 1,188,573 A2 relates to a recording material comprising in order: a sheet-like paper substrate, at least one pigment layer coated thereon, and at least one sealing layer coated thereon. Also disclosed is an optional dye trapping layer present between the pigment layer and the sealing layer. There are several problems with this element in that the binder in the sealing layer is water-soluble which degrades the water resistance of sealed prints. While the sealing layer is porous, the dye trapping layer is not, which leads to bleed and degraded image quality.

It is an object of this invention to provide an inkjet recording element which can be printed with inkjet inks and fused to provide high density images. It is another object of the invention to provide an uppermost porous ink-transporting layer that has good mechanical integrity and is abrasion resistant. It is another object of the invention to provide an uppermost ink-transporting layer that is thermally fusible and thereby can be rendered water resistant. It is another object to provide an inkjet recording element that has immediately underneath the ink-transporting layer a fusible porous ink-receptive layer which has a greater affinity for the ink fluid than the upper layer, and retains inkjet colorants, and which can be subsequently fused. It is a further object of this invention to provide an element that has an uppermost porous ink-transporting layer and an underlying porous ink-receptive layer both of which can be fused to remove light scatter to provide excellent image density.

SUMMARY OF THE INVENTION

These and other objects are achieved in accordance with the invention which comprises an inkjet recording element comprising a support having thereon in order:

a) a fusible, porous ink-receptive layer comprising fusible polymeric particles, and a binder; and b) a fusible, porous ink-transporting layer comprising fusible, polymeric particles and a film-forming, hydrophobic binder;

wherein there is no porous, ink carrier liquid-receptive layer between the ink-receptive layer and the support, that is capable of receiving a substantial amount of ink carrier liquid after the ink carrier liquid has passed through the ink-receptive layer.

By use of the invention, a porous inkjet recording element is obtained that has good abrasion resistance, and which when printed with an inkjet ink, and subsequently fused, has good water-resistance and high print density.

The invention is also directed to an inkjet printing process, comprising the steps of:

A) providing an inkjet printer that is responsive to digital data signals;

B) loading the inkjet printer with the inkjet recording element described above;

C) loading the inkjet printer with inkjet ink compositions; and

D) printing on the inkjet recording element using the inkjet ink compositions in response to the digital data signals; and E) fusing both the ink-receptive layer and the ink-transporting layer of the inkjet recording element.

The term "uppermost" as used herein means that side of the receiver where the ink composition is applied.

DETAILED DESCRIPTION OF THE INVENTION

The fusible porous ink-transporting layer, the uppermost layer, allows for passage of the ink to the underlying layers, but is substantially non-retentive of the colorant. The underlying fusible porous ink-receptive layer has a mean pore size smaller than the mean pore size of the uppermost fusible layer. This pore size hierarchy establishes a capillary pressure in the printed areas that is capable of driving the ink fluid into the smaller capillaries of the lower layer.

The fusible, polymeric particles employed in the ink-transporting layer of the invention may have any particle size provided they will form a porous layer whose mean pore radius is greater than the underlying fusible ink receptive layer. In a preferred embodiment of the invention, the particle size of the fusible, polymeric particle may range from about 0.2 to about 10 μm. Generally, the pore size hierarchy requirement can be met having the larger fusible polymeric particles in the uppermost fusible layer.

Upon fusing of the polymeric particles, the air particle interfaces present in the original porous structure of the layer are eliminated and a non-scattering, substantially continuous, protective overcoat forms over the image. The fusible, polymeric particles may be formed from a condensation polymer, a styrenic polymer, a vinyl polymer, an ethylene-vinyl chloride copolymer, a polyacrylate, poly(vinyl acetate), poly(vinylidene chloride), or a vinyl acetate-vinyl chloride copolymer. In a preferred embodiment of the invention, the fusible, polymeric particles are comprised of a cellulose acetate ester, a polyester or a polyurethane. Most preferred is a cellulose acetate butyrate.

The porous ink-transporting layer of fusible polymeric particles will additionally contain a film-forming hydrophobic binder. The film-forming, hydrophobic binder useful in the invention can be any film-forming hydrophobic polymer capable of being dispersed in water. In a preferred embodiment of the invention, the hydrophobic binder is an aqueous dispersion of an acrylic polymer or a polyurethane.

In order to be non-retentive of the colorant, the polymers comprising the fusible particles and the hydrophobic binder should either be non-ionic or of the same charge type as the colorant. Since inkjet colorants are usually anionic, in a preferred embodiment both the fusible polymeric particles and the hydrophobic film-forming binder are either nonionic or anionic. Accordingly, in a most preferred embodiment, the polymers comprising the fusible particles and the film-forming hydrophobic binder shall either have no ionic functionality or anionic functionality.

The particle-to-binder ratio of the particles and binder employed in the ink-transporting layer can range between about 98:2 and 60:40, preferably between about 95:5 and about 80:20. In general, a layer having particle-to-binder ratios above the range stated will usually not have sufficient cohesive strength; and a layer having particle-to-binder ratios below the range stated will usually not be sufficiently porous to provide good image quality.

The ink-transporting layer is usually present in an amount from about 1 $g/m^2$ to about 50 $g/m^2$. In a preferred embodiment, the ink-transporting layer is present in an amount from about 1 $g/m^2$ to about 10 $g/m^2$.

The porous fusible ink-receptive layer receives the ink, i.e. fluid and colorant, from the uppermost ink-transporting layer, and retains substantially all the colorant. Upon fusing, via the application of heat and/or pressure, the air particle interfaces present in the original porous structure of the layer are eliminated, and a non-scattering substantially continuous layer forms which contains the image. It is an important feature of the invention that the uppermost ink-transporting layer and the underlying ink-receptive layer both be fusible into non-scattering layers, as this significantly raises image density.

The fusible, polymeric particles employed in the ink-receptive layer of the invention ranges from about 0.1 μm to 10 μm. In a preferred embodiment of the invention, the particle size of the fusible, polymeric particle in the ink-receptive layer is smaller than the particles employed in the porous, ink-transporting layer. This generally will provide a structure which meets the desired aforementioned pore size hierarchy.

The particles employed in the ink-receptive layer may be formed from any polymer which is fusible, i.e., capable of being converted from discrete particles into a substantially continuous layer through the application of heat and/or pressure. In a preferred embodiment of the invention, the fusible, polymeric particles comprise a condensation polymer, a styrenic polymer, a vinyl polymer, an ethylene-vinyl chloride copolymer, a polyacrylate, poly(vinyl acetate), poly (vinylidene chloride), and a vinyl acetate-vinyl chloride copolymer. In still another preferred embodiment, the condensation polymer may be a polyester or polyurethane. In a most preferred embodiment of the invention, the fusible, polymeric particles are comprised of a copolymer of 86 parts by weight of ethyl methacrylate and 14 parts by weight of methyl methacrylate, Tg=85 C.

The binder employed in the ink-receptive layer can be any film-forming polymer that serves to bind together the fusible polymeric particles. In a preferred embodiment of the invention, the binder is a hydrophobic film forming binder derived from an aqueous dispersion of an acrylic polymer or a polyurethane.

Optionally a dye mordant can be employed in the ink-receptive layer. The dye mordant can be any material which is substantive to inkjet dyes. The dye mordant fixes the dye within the porous fusible ink-receptive layer. This is especially desirable if a porous support, described below, which is capable of further absorption of the ink carrier liquid underlies the fusible porous ink-receptive layer. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quartenary ammonium compounds, or basic polymers, such as poly(dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly(3-N,N,N-trimethyl-ammonium)

propyl methacrylate chloride; a copolymer of vinylpyrrolidinone and vinyl(N-methylimidazolium chloride; and hydroxyethylcellulose derivatized with 3-N,N,N-triiethylammonium)propyl chloride. In a preferred embodiment, the cationic mordant is a quaternary ammonium compound.

In order to be compatible with the mordant, both the binder and the polymer comprising the fusible particles should be either uncharged or the same charge as the mordant. Colloidal instability and unwanted aggregation would result if the polymer particles or the binder had a charge opposite from that of the mordant.

In one preferred embodiment of the invention, the fusible particles in the ink-receptive layer may range from about 95 to about 60 parts by weight, the binder may range from about 40 to about 5 parts by weight, and the dye mordant may range from about 2 parts to about 40 parts by weight. Most preferred is 80 parts by weight fusible particles, 10 parts by weight binder, and 10 parts by weight dye mordant.

The ink-receptive layer is present in an amount from about 1 g/m$^2$ to about 80 g/m$^2$. In a preferred embodiment, the ink-receptive layer is present in an amount from about 20 g/m$^2$ to about 40 g/m$^2$. The thickness of the ink-receptive layer will depend on whether the underlying support is porous and capable of absorbing or contributing to the absorbance of the liquid carrier. Preferably, the total absorbent capacity of (i) the ink receptive layer alone or (ii) if porous, the support alone or (iii) the combination of the ink receptive layer and, if porous, the support is, in each case, preferably at least about 10 cc/m$^2$, although the desired absorbent capacity is related to the amount of fluid applied which amount may vary depending on the printer and the ink composition employed. By a total absorbant capability of at least 10.0 cc/m$^2$ is meant that the capacity is such as to enable at least 10.0 cc of ink to be absorbed per 1 m$^2$. For the ink receptive layer the absorbant capacity is taken as the void volume determined via mercury intrusion porosimetry. For voided supports absorbant capacity is a calculated number, based on the thickness of the layer or layers. In the case of voided layers, the desired thickness can be determined by using the formula $t(cm)=10.0\ cm^3/(v\times10^4\ cm^2)$ where v is the void volume fraction defined as the ratio of voided thickness minus unvoided thickness to the voided thickness. The actual thickness, if an extruded monolayer, can be easily measured. If a co-extruded layer, photomicroscopy of a cross-section can be used to determine the actual thickness. The unvoided thickness is defined as the thickness that would be expected had no voiding occurred, for example, the cast thickness divided by the stretch ratio in the machine direction and the stretch ratio in the cross direction.

In order to impart mechanical durability to an inkjet recording element, crosslinkers which act upon a binder may be added in small quantities to the ink-receptive layer or the ink-transporting layer. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chromalum, zirconium sulfate and the like may be used. Preferably, the crosslinker is an aldehyde, an acetal or a ketal, such as 2,3-dihydroxy-1,4-dioxane.

The support used in the inkjet recording element of the invention may be opaque, translucent, or transparent. Typically, the support is a self-standing material for providing structural rigidity. In the preferred embodiment, the other layers of the inkjet recording element, including the ink-receptive layer and the ink-transporting layer, are coated on the support. The support may itself be porous or non-porous. There may be used, for example, porous supports such as, plain papers, open-pore polyolefins, open-pore polyesters, or an open pore membrane.

In one embodiment of the present invention a porous polyester support such as disclosed in U.S. Pat. No. 6,379,780 to Laney et al. and U.S. Pat. No. 6,489,008, the disclosures of both of which is hereby incorporated by reference, can be used. This polyester support comprises a base polyester layer and an ink-liquid-carrier permeable upper polyester layer, the upper polyester layer comprising a continuous polyester phase having a total absorbent capacity of at least about 14 cc/m$^2$ but which absorbent capacity can be adjusted as desired for use in the present invention.

In another embodiment, an open pore membrane can be used in the support and can be formed in accordance with the known technique of phase inversion. Examples of a porous layer comprising an open-pore membrane, for use in a support, are disclosed in U.S. Ser. No. 09/626,752 and U.S. Ser. No. 09/626,883, both of Landry-Coltrain et al., filed Jul. 27, 2000, hereby incorporated by reference.

In still another embodiment, a porous support can comprise poly(lactic acid), for example, as disclosed in copending commonly assigned U.S. Ser. No. 10/722,886, hereby incorporated by reference in its entirety. In this embodiment, a microvoided polylactic-acid-containing layer can have levels of voiding, thickness, and smoothness adjusted to provide desired absorbency or other properties. The polylactic acid-containing layer can advantageously also provide stiffness to the media and physical integrity to other layers. The thickness of the microvoided polylactic acid layer can be 30 to 400 μm depending on the required stiffniess of the recording element. Typically, a thickness of at least about 28.0 μm is needed to achieve a total absorbency of 10 cc/m$^2$ if desired for use as a carrier liquid retaining layer.

If a porous support is employed it may be advantageous for the support to have a pore size smaller than that of the ink-receptive layer. For example, a permeable microvoided or otherwise porous support contains voids that are interconnected or open-celled in structure and can enhance the liquid carrier absorption rate by enabling capillary action to occur. Maintaining the correct pore size hierarchy can afford access to the pore capacity of the support and eliminate capacity related bleed. Capacity related bleed occurs when insufficient void volume is available to accommodate the ink, resulting in unwanted lateral spreading of the colorant.

Non-porous supports can be for example, resin-coated papers, various plastics including a polyester resin such as poly(ethylene terephthalate), poly(ethylene naphthalate) and poly(ester diacetate), a polycarbonate resin, a fluorine resin such as poly(tetra-fluoro ethylene), metal foil, various glass materials, and the like. The thickness of the support employed in the invention can be from about 12 to about 500 μm, preferably from about 75 to about 300 μm.

If desired, in order to improve the adhesion to the support of the first coated layer, which may be the ink-receptive layer or an intermediate layer (which can be referred to as a base layer), the surface of the support may optionally be corona-discharge-treated prior to applying the base layer or ink-receptive layer to the support. The present invention differs from copending commonly assigned U.S. Ser. No. 10/260,663, hereby incorporated by reference in its entirety, in that there is an absence of a porous ink carrier liquid receptive layer. Such an ink carrier liquid receptive layer is unnecessary, since its function is carried out, in the present invention, by either the porous fusible ink-receptive layer or a porous support or a combination of both. In a preferred embodiment of the invention, at least about 75 weight percent of the ink carrier liquid when applied to the receiver is retained until dried by the fusible porous ink-receptive layer, or a porous support in combination with the fusible porous ink-receptive layer.

Since the image recording element may come in contact with other image recording articles or the drive or transport mechanisms of image recording devices, additives such as surfactants, lubricants, matte particles, and the like may be added to the element to the extent that they do not degrade the properties of interest.

The layers described above, including the ink-receptive layer, and the ink-transporting layer, may be coated by conventional coating means onto a support material commonly used in this art. Coating methods may include, but are not limited to, wound wire rod coating, slot coating, slide hopper coating, gravure, curtain coating, and the like. Some of these methods allow for simultaneous coatings of all three layers, which is preferred from a manufacturing economic perspective.

After printing on the element of the invention, the fusible, porous ink-transporting layer is heat and/or pressure fused to form a substantially continuous overcoat layer on the surface. In addition, the ink-receptive layer is also fused at the same time. Upon fusing, these layers are rendered non-light scattering. Fusing may be accomplished in any manner which is effective for the intended purpose. A description of a fusing method employing a fusing belt can be found in U.S. Pat. No. 5,258,256, and a description of a fusing method employing a fusing roller can be found in U.S. Pat. No. 4,913,991, the disclosures of which are hereby incorporated by reference.

In a preferred embodiment, fusing is accomplished by contacting the surface of the element with a heat fusing member, such as a fusing roller or fusing belt. Thus, for example, fusing can be accomplished by passing the element through a pair of heated rollers, heated to a temperature of about 60° C. to about 160° C., using a pressure of about 0.4 to about 0.7 MPa at a transport rate of about 0.005 m/sec to about 0.5 m/sec.

Inkjet inks used to image the recording elements of the present invention are well known in the art. The ink compositions used in inkjet printing typically are liquid compositions comprising a solvent or carrier liquid, colorants such as dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758, the disclosures of which are hereby incorporated by reference.

The following examples further illustrate the invention.

EXAMPLE

Synthesis of Fusible Polymeric Particles For Fusible Ink-receptive Layer

A 12-liter, Morton® reaction flask was charged with 4 Kg of demineralized water. The flask contents were heated to 80° C. while stirring at 150 rpm under a nitrogen atmosphere. The initiator solution addition flask was made up with 1974 g of demineralized water and 26.4 g of 2,2'-azobis (2-methylpropionamide)dihydrochloride. A monomer phase addition flask was prepared by adding 2182 g of ethyl methacrylate, and 364 g of methyl methacrylate. Then, charges to the reaction flask from each addition flask were started at 5 g per minute. The addition flasks were recharged as needed. Samples were taken at various times and the monomer phase feed was stopped when the desired latex particle size was reached. The charges of the redox initiator solutions were extended for 30 minutes beyond the end of the monomer phase addition to react with residual monomers. The reaction flask contents were stirred at 80° C. for one hour followed by cooling to 20° C., and filtration through 200 μm polycloth material. The latex was concentrated by ultrafiltration to obtain a 50.7% solids dispersion of cationically charged surfactant-free 0.45 μm poly (ethylmethacrylate-co-methylmethacrylate) particles, as determined using a Horiba® LA-920 Particle Size Analyzer, with a Tg=85 C.

Preparation of Porous Fusible Ink-receptive Layer

A coating solution at 38% solids was prepared by combining 397 g of the 50.7% solids dispersion of poly(ethylmethacrylate-co-methylmethacrylate) fusible polymeric particles prepared above, with 72 g of a film forming hydrophobic binder Witcobond®W320 Uniroyal Chemical Co.) a 35% by weight aqueous dispersion of 1.9 μm polyurethane particles Tg=−12° C., and 18.2 g of a 10% solution of Olin® 10G surfactant and the requisite amount of water. The coating solution was hopper coated at a solids laydown of 31 g/m$^2$ onto a corona treated paper support Domtar® 801b Quantum, available from Domtar, Inc. and force air dried to give a porous, fusible ink-receptive layer having 89 parts by weight of fusible polymeric particles, 11 parts by weight of film forming hydrophobic binder. The void volume of this layer, determined by mercury intrusion porosimetry, was 14 cc/m$^2$.

Preparation of Control Porous Ink-receptive Layer (Non-fusible Refractory Particles)

A coating solution at 30% solids was prepared by combining 231 g of a 34.5% dispersion of cationic colloidal alumina Catapal 200®, CONDEA Vista Co non-fusible particles, 49 g of a 16.5% solution of poly(vinyl alcohol) GH-17®, Nippon Gohsei, The Nippon Synthetic Chemical Industry Co., Ltd Co., 1.8 g of dihydroxydioxane crosslinking agent, 2.7 g of Olin 10G surfactant and the requisite quantity of deionized water. The coating solution was hopper coated at a solids laydown of 31 g/m$^2$ onto a corona treated paper support Domtar 801b Quantum®, available from Domtar, Inc. and force air dried to give a porous, non-fusible refractory ink receiving layer having 91 parts by weight of non-fusible refractory particles, and 9 parts by weight crosslinked poly(vinyl alcohol) binder. The void volume of this layer, determined by mercury intrusion porosimetry, was 25 cc/m$^2$.

Synthesis of Fusible Polymeric Particles For Ink-transporting Layer

An ethylacetate solution was prepared by dissolving 92.25 g of cellulose acetate butyrate (Eastman Chemical Company CAB-551-0.2) in 153.75 grams of ethyl acetate at 65° C. with stirring. An aqueous solution was prepared combining 24 g of a 10% solution of Calfax® DB-45 (Pilot Chemical Company) and 330 g of water and heated to 65° C. The aqueous phase composition was added to the organic phase composition while mixing vigorously with a propeller mixer and then converted to a crude emulsion by homogenizing for 2 minutes with a Silverson® rotor-stator mixer at 5000 rpm. The crude emulsion was passed through a Microfluidics Model 110F Microfluidizer® one time at 31 MPa and collected in a round bottom flask. Rotary evaporation of the homogenized mixture at 65° C. under vacuum to remove the ethyl acetate afforded a 47% solids dispersion of 1.2 μm cellulose acetate butyrate particles, as determined using a Horiba® LA-920 Particle Size Analyzer, dispersed in water.

Preparation of Porous Fusible Ink-transporting Layer

A coating solution at 30% solids was prepared by adding 426 g of the 47% solids dispersion of cellulose acetate butyrate particles prepared above, 64 g of binder Witcobond®W320 a 35% by weight aqueous dispersion of 1.9 μm polyurethane particles Tg=−12° C., 20.3 g Olin® 10G 10% surfactant, and 11 g of FSN 10% surfactant, and the request amount of water of dilution. The coating solution was hopper coated at 8.6 g/m$^2$ onto the above prepared porous fusible ink-receptive layer to give the Inventive Element. The same coating solution was hopper coated at 8.6 g/m$^2$ onto the above prepared non-fusible ink-receptive layer to give the Control Element. The void volume of this layer, determined by mercury intrusion porosimetry, was 6 cc/m$^2$.

Pore Size Distributions and Void Volumes

Pore size distributions and void volumes were measured for each of the above described ink-transporting and ink-receptive layers by mercury intrusion porosimetry. Measurements were obtained for each coated at the above described compositions and coat weights on a polyester support.

Printing

A density test target was printed on the Inventive Element and the Control Element with a Hewlett-Packard Photosmart® printer using best mode, glossy photographic paper setting and print cartridges C3844A and C3845A. The density target had solid rectangles with each of the primary subtractive colors, i.e., C, M, Y, K.

Fusing

The printed Element and Control were fused in a heated nip at 150° C. and 4.2 kg/cm$^2$ against a sol-gel coated polyimide belt at 63.5 cm/min.

Testing

Densities of the fused prints were measured with a Spectrolina® Densitometer. Optical densities greater than 2.0 are considered acceptable. The following results were obtained:

TABLE 1

| Element | Fused | Pore Size, nm Upper/Lower | Cyan | Magenta | Yellow | Black |
|---|---|---|---|---|---|---|
| Invention | No | 268/110 | 0.51 | 0.42 | 0.44 | 0.49 |
| Invention | Yes | NA | 2.23 | 2.07 | 1.87 | 2.35 |
| Control | No | 268/31 | 0.41 | 0.39 | 0.38 | 0.52 |
| Control | Yes | NA/31 | 1.96 | 1.59 | 1.47 | 1.76 |

The above results show that the fused Inventive Element having both a fusible ink-transporting and a fusible ink-retaining layer gave superior densities to the fused Control Element having only a fusible ink-transporting layer.

Although the invention has been described in detail with reference to certain preferred embodiments for the purpose of illustration, it is to be understood that variations and modifications can be made by those skilled in the art without departing from the spirit and scope of the invention.

The invention claimed is:

1. An inkjet printing process, comprising the steps of:

A) providing an inkjet printer that is responsive to digital data signals;

B) loading the inkjet printer with an inkjet recording element, the inkjet recording element comprising a support having thereon in order:

a) a fusible, porous ink-receptive layer comprising fusible, polymeric particles, and a binder;

b) a fusible, porous ink-transporting layer comprising fusible, polymeric particles and a film-forming, hydrophobic binder, which layer is the uppermost layer;

wherein there is no porous ink-carrier-liquid-receptive layer, between the ink-receptive layer and the support, that is capable of receiving a substantial amount of ink carrier liquid after the ink carrier liquid has passed through the porous ink-receptive layer;

C) loading the inkjet printer with an inkjet ink composition;

D) printing an image on the inkjet recording element using the inkjet ink composition in response to the digital data signals, wherein the fusible, porous ink-transporting layer is substantially non-retentive of colorant, allowing for passage of fluid and colorant in the inkjet ink composition to the underlying fusible, porous ink-receptive layer which then contains the image; and E) fusing both the ink-receptive layer and the ink-transporting layer.

2. The inkjet printing process of claim 1 wherein the ink-receptive layer and/or the support, each either alone or in combination, is capable of receiving substantially all of the ink carrier liquid received after the ink carrier liquid has passed through the ink-transporting layer.

3. The inkjet printing process of claim 2 wherein the inkjet recording element comprises an ink-receptive layer and a support, and wherein the ink-receptive layer and/or the support, each either alone or in combination, is capable of receiving at least 10 cc/m$^2$ of the ink carrier liquid.

4. The inkjet printing process of claim 1 wherein the support is non-porous and the ink-receptive layer alone is capable of receiving at least 10 cc/m$^2$ of the ink carrier liquid.

5. The inkjet printing process of claim 1 wherein the support is porous and is capable of receiving at least 10 cc/m$^2$ of the ink carrier liquid.

6. The inkjet printing process of claim 1 wherein the support is porous and the ink-receiving layer and the support in combination is capable of receiving at least 10 cc/m$^2$ of the ink carrier liquid.

7. The inkjet printing process of claim 1 wherein said fusible, porous ink-transporting layer has a mean pore diameter greater than the underlying fusible, porous ink-receptive layer.

8. The inkjet printing process of claim 1 wherein the support is porous and comprises voided polyester.

9. The inkjet printing process of claim 1 wherein the support is porous and comprises an open pore membrane.

10. The inkjet printing process of claim 1 wherein the particles of the fusible, porous ink-receptive layer are smaller than the particles of the fusible, porous ink-transporting layer, the support is porous, and the support has a pore size that is smaller than that of the fusible, porous ink-receptive layer.

11. The inkjet printing process of claim 1 wherein the fusible polymeric particles in the fusible, porous ink-receptive layer comprise a condensation polymer, a styrenic polymer, a vinyl polymer, an ethylene-vinyl chloride copolymer, a polyacrylate, poly(vinyl acetate), poly(vinylidene chloride), a vinyl acetate-vinyl chloride copolymer, a polyester, or a polyurethane.

12. The inkjet printing process of claim 1 wherein the fusible polymeric particles in the fusible, porous ink-receptive layer comprise a copolymer of ethyl methacrylate and methyl methacrylate.

13. The inkjet printing process of claim 1 wherein the binder in the fusible, porous ink-receptive layer comprises an aqueous dispersion of an acrylic polymer or a polyurethane.

14. The inkjet printing process of claim 1 wherein the fusible polymeric particles in said fusible, porous ink-receptive layer are cationic.

15. The inkjet printing process of claim 1 wherein a mordant is in the fusible, porous ink-receptive layer.

16. The inkjet printing process of claim 15 wherein the mordant comprises a cationic latex.

17. The inkjet printing process of claim 1 wherein the fusible, polymeric particles in the fusible, porous ink-transporting layer range in size from about 0.5 to about 10 μm.

18. The inkjet printing process of claim 1 wherein the particle-to-binder ratio of the fusible, polymeric particles and the film-forming, hydrophobic binder in the ink-transporting layer is between about 95:5 and 60:40.

19. The inkjet printing process of claim 1 wherein the fusible polymeric particles in the ink-transporting layer comprise a condensation polymer, a styrenic polymer, a vinyl polymer, an ethylene-vinyl chloride copolymer, a polyacrylate, poly(vinyl acetate), a poly(vinylidene chloride), a vinyl acetate-vinyl chloride copolymer, a polyester, or a polyurethane.

20. The inkjet printing process of claim 1 wherein the fusible polymeric particles in the ink-transporting layer comprise a cellulose acetate ester.

21. The inkjet printing process of claim 1 wherein the inkjet recording element comprises a support having thereon in order:

a) a fusible, porous ink-receptive layer comprising fusible polymeric particles, and a binder; and b) a fusible, porous ink-transporting layer comprising fusible, polymeric particles and a film-forming, hydrophobic binder;

wherein the ink-receptive layer and the support are capable of receiving at least 10 $cc/m^2$ of ink carrier liquid after the ink carrier liquid has passed through the ink-transporting layer.

* * * * *